US006386784B1

(12) United States Patent
Ruble

(10) Patent No.: US 6,386,784 B1
(45) Date of Patent: May 14, 2002

(54) FULLY INTERCHANGEABLE AND RECYCLABLE BINDER COVER AND BINDING MECHANISM

(76) Inventor: Paul Edward Ruble, 249 Devia Dr., Newbury Park, CA (US) 91320

( * ) Notice: Subject to any disclaimer, the term of this patent is extended or adjusted under 35 U.S.C. 154(b) by 0 days.

(21) Appl. No.: 09/379,966

(22) Filed: Aug. 24, 1999

Related U.S. Application Data

(63) Continuation-in-part of application No. 09/316,238, filed on May 21, 1999, now abandoned, which is a continuation-in-part of application No. 08/977,304, filed on Nov. 24, 1997, now abandoned.

(51) Int. Cl.[7] ..... B42F 3/00

(52) U.S. Cl. ..... 402/60; 24/67 R; 24/67.11; 281/15.1; 402/70; 402/75; D19/26

(58) Field of Search ..... 281/15.1, 21.1, 281/29, 31, 36, 37, 38, 34; 283/64, 60; 402/70, 73, 60, 75, 79; 24/67 R, 67.9, 67.11; D19/26, 27, 32, 33

(56) References Cited

U.S. PATENT DOCUMENTS

| | | | | | |
|---|---|---|---|---|---|
| 1,148,123 | A | * | 7/1915 | Robinson | |
| 1,552,815 | A | * | 9/1925 | Baldwin | |
| 1,582,458 | A | * | 4/1926 | Fortney | |
| 1,709,450 | A | * | 4/1929 | White | |
| 2,333,523 | A | * | 11/1943 | Cohun | |
| 2,583,998 | A | * | 1/1952 | Cook | 281/19.1 |
| 4,274,659 | A | * | 6/1981 | D'Ambrosio | 281/34 |
| 4,650,216 | A | * | 3/1987 | Carlson | 281/34 |
| 4,681,472 | A | | 7/1987 | Ruble | 402/3 |
| 4,811,973 | A | * | 3/1989 | Kumar-Misir | 281/21 A |
| 4,893,937 | A | * | 1/1990 | Pugliese et al. | 281/31 |
| 4,962,949 | A | * | 10/1990 | Gibbs | 281/35 |
| 5,029,900 | A | * | 7/1991 | Axelrod | 281/34 |
| 5,186,565 | A | * | 2/1993 | Jack | 402/79 |
| 5,219,437 | A | * | 6/1993 | Moor et al. | 281/29 |
| 5,471,347 | A | * | 11/1995 | Galiani | 359/807 |
| 6,000,873 | A | * | 12/1999 | Burton | 402/75 |
| 6,186,690 | B1 | * | 2/2001 | Duncan | 402/8 |

* cited by examiner

*Primary Examiner*—A. L. Wellington
*Assistant Examiner*—Monica Carter
(74) *Attorney, Agent, or Firm*—Koppel, Jacobs, Patrick & Heybl

(57) ABSTRACT

A hardcover binder that can be interchanged with a variety of binding mechanisms. A binding mechanism is removably mounted in the binder hardcover allowing for removal of the binding mechanism for recycling or replacement of the binding mechanism or binder hardcover. The hardcover has a pair of interior pockets that are offset from and open towards the hardcover's spine. The invention comes with a pair of inserts that can be perforated and integrated with binding mechanisms such as plastic comb or spiral. In the case of a 3-ring binding mechanism, the inserts can be affixed to the binding mechanism or the binding mechanism can be mounted on a single section of insert material resulting in two insert flaps that function the same as the inserts. The inserts (or flaps) are removably inserted and fit snugly into the interior pockets to anchor the binding mechanism against the spine and between the hardcover. In the case of D-ring binding mechanisms, opposing interior pockets are formed on the interior of the hardcover back panel and the hardcover back panel such that the D-ring binding mechanism is mounted on the back panel.

37 Claims, 11 Drawing Sheets

FULLY INTERCHANGEABLE AND RECYCLABLE BINDER COVER AND BINDING MECHANISM

The following application, is a continuation-in-part of application Ser. No. 09/316,238, filed on May 21, 1999, abandoned to Ruble, which is a continuation-in-part of application Ser. No. 08/977,304, filed on Nov. 24, 1997, now abandoned also to Ruble.

BACKGROUND OF THE INVENTION

1. Field of the Invention

This invention relates to binders for paper material and the like and more specifically to a hardcover binders having removable and interchangeable binding mechanisms.

2. Description of the Related Art

Many different techniques ranging from paper clips and staples, 3-ring binders, pocket organizers, mechanical binders to a "perfect" binding are used to bind and organize printed materials. A myriad of factors will determine which binding is used in a particular application. Typical considerations include cost, ease of use, the ability to stand, label and protect the bound material as well as the ability to bind the materials on-site in a timely manner.

Books are generally bound using the perfect binding method or in the case of high end books, the "sewn and stitch" method. These approaches provide a stiff binding that can be stood on a bookshelf, a wide rigid spine that can be printed to label the book, and a hardcover that protects the paper. However, perfect or sewn and stitched bindings must be done off-site by a professional book binder, which is very expensive and may take several weeks.

3-ring (including D-ring binders) are a popular means of binding and organizing printed material and commonly comprise a binder hardcover and a 3-ring binding mechanism, with the binding mechanism permanently affixed to the spine on the inside of the hardcover. These binders are desirable because the binding mechanism can be opened and closed during the life of the binder to add or remove printed material. The useful life of a 3-ring type binder typically ends upon failure of the hardcover or the binding mechanism and often times the hardcover will fail or wear out before the binding mechanism or vice versa. With a failure, the binding mechanism cannot be easily removed from hardcover for recycling and often, both will be damaged during the removal process. Further, additional costs are incurred by transporting the 3-ring binder to the location for separating the two. Upon failure of either, the entire 3-ring type binder is disposed of, wasting the operable portions of the binder. If the binding mechanism could be easily removed, the material from the hardcover (PVC or chipboard) could be recycled and the binding mechanism could be recycled.

A 3-ring binder is typically manufactured at one location and shipped to a retail location for sale to the public. Often times a surplus inventory is maintained at the retail location and a supply is kept on the retail sales floor. Inevitably, storage and shelf space are limited and any means of reducing the storage or shelf space needed for a particular product is desirable. During manufacture, the 3-ring binding mechanism is permanently affixed to binder hardcover and the binder is shipped as a complete unit. The binders are folded with an empty binding mechanism and stacked in a box. This manner of shipping is inefficient because of the large amount of empty space within the shipping container and results in shipping large boxes with relatively few binders. The binders are generally stored at the retail location in the same manner, resulting in a waste of inventory storage space and retail shelf space.

Another disadvantage of the 3-ring type binder is that when it is filled with printed material, the rings can unintentionally open when the binder is jarred. For instance, filled 3-ring binders are often carried in briefcases with the spine to the top and the open end to the bottom. If the briefcase is jarred, the force of the printed material on the rings can cause the rings to open and cause the printed material to fall out of the binder.

Another drawback of conventional 3-ring hardcover binders is the inability to interchange the hardcover with different types of binding mechanisms. If a hardcover is dedicated as a 3-ring binder, the 3-ring binding mechanism is affixed to the hardcover, usually by riveting, and cannot be removed and replaced with another type of binding mechanisms such as plastic comb, spiral, double wire, Vellobind or thermal bind.

Binding mechanisms that provide a soft cover are also popular for binding printed material. Large and small businesses generate and bind their own reports, brochures, manuals, etc. on a daily basis that are often generated at fairly low volume. There can be significant time pressure to have the material bound as soon as practicable after it is generated. Book bindings is just too expensive and creates too much of a delay for these types of business documents.

As a result, businesses often resort to other binding mechanisms such as a plastic comb, spiral wire, double wire, VELOBIND® or thermal bind to bind their business documents. The documents are punched and hand fed to a machine that joins the binding element to the document. The machine, binding elements and labor costs required to bind low volume documents are much less than a book binding methods. Furthermore, these binding methods can be done on-site as soon as the document is generated.

Although extremely popular, these binding mechanisms have a number of drawbacks. A soft cover is generally bound with the printed material and provides little protection for the material and is incapable of standing. These binding mechanisms cannot be integrated with a hardcover binder. Furthermore, the binding mechanism cannot be conveniently labeled using imprinting techniques or the self-loading labeling technique described in U.S. Pat. No. 4,681,472.

Binding companies have attempted, largely unsuccessfully, to address some of these drawbacks. One approach is the multi-purpose pocket organizer, in which the hard front cover is provided with a horizontal pocket, spring clip, 3-ring or some other means of holding loose paper and the hard back cover is provided with a single vertical pocket. The mechanical binding's back cover is formed from a rigid material such as card board and inserted into the vertical pocket so that the mechanically bound document is held against the back cover.

This type of pocket organizer provides the desirable properties of the perfect binding, is relatively inexpensive and easy to use, and provides a binder for both loose leaf and previously mechanically bound material. The primary drawback to the pocket organizer is that the mechanical binding tends to move side-to-side and fall out of the organizer. This problem is annoying enough that businesses rarely if ever publish their documents in this manner, opting for the simpler binding mechanisms with soft covers.

VELOBIND Co., which is owned by General Binding Corporation, developed a hardcover that is sold with a pair of crack and peel inserts that are bound with the soft mechanical binding and permanently adhered to the interior surfaces of the front and back covers. The crack and peel inserts are very expensive and difficult to properly align to the front and back covers. The user has only one chance to align the adhesive inserts correctly. Oftentimes the result is either that the binding is crooked or that it must be discarded at great expense. Once again, because of the expense and the difficulty of this approach, businesses continue to overwhelmingly choose the plain soft mechanical binding for their internally generated documents.

SUMMARY OF THE INVENTION

In view of the above problems, the present invention provides a fully interchangeable hardcover binder that can be removably mated with a variety of binding mechanisms such as 3-ring, D-ring, plastic comb, spiral, double wire, Velobind or thermal bind. The removable nature of the binding mechanism allows the hardcover binder to be re-used with various binding mechanisms and allows the binding mechanisms to be mated with different hardcover binders. The invention also provides for efficient shipping and storage and allows the binder hardcover and binding mechanisms to be recycled. The invention also allows binding mechanisms previously bound with printed material having a soft cover to be removably mated with a binding hardcover. The hardcover provides protection and stiffness and allows labeling. Once mated with the hardcover, the previously soft bound material can more easily stored in a bookshelf with the labels on the hardcovers displayed.

The invention provides a binding hardcover, a binding mechanism and a pair of insert pieces (or flaps). The inserts are part of the inventive binder and generally not part of the printed material unless collated or bound with the printed material. The binder hardcover has a pair of interior pockets that are offset from and open towards the cover's spine. The binding mechanisms come with a pair of inserts that can be bound as part of a binding mechanism or otherwise affixed to the binding mechanism. The inserts can be inserted and fit snugly into the pockets to hold the binding mechanism against the spine and between the cover. The inserts are preferably formed with a tip that makes initial insertion into the pocket easier and taper so that the insert attains a height approximately equal to the height of the pocket to provide the snug fit. The offset of the pockets is preferably wide enough that the inserts do not pinch the binding mechanism when the cover is closed and narrow enough to constrain the side-to-side movement of the binding mechanism when the cover is open, suitably between one and two times the radius of the mechanical binding.

In the case of a 3-ring binder, the binding mechanism can also be affixed to two inserts, the inserts oriented with the tips directed out. Alternatively, the binding mechanism can be affixed to the vertical center line of a single section of insert material having a shape similar to the two inserts laid side by side, with the insert tips opposing. When affixed to the single section, the 3-ring binder mechanism has two opposing flaps that are similar in composition and shape to the insert pairs. The flaps are inserted into the pocket and taper so that the insert attains a height approximately equal to the height of the pocket. The flaps fit snugly into the pockets to hold the 3-ring binding mechanism against the spine and between the cover.

The edge of the pockets will allow slight movement of inserts and binding mechanism if the binder is jarred. This slight movement provides a cushion that helps prevent the printed material forcing the rings open and allowing the printed material to fall out.

The 3-ring binding mechanism can also be used with a hardcover that has full size interior pockets opening toward the hardcover spine and the pocket edge having a tab running the length of the pocket opening. When the 3-ring binding mechanism is installed the inserts will fit snugly in the pockets, with the tabs placed under the binding element. In this embodiment the pocket edges are not visible, giving the binder the appearance of a binder with a permanently affixed binding mechanism.

The invention can also be used with D-ring binders that are commonly mounted on the back panel of the hardcover, not the spine. The back panel has an interior pocket that is offset and opened toward the spine, and the spine has a pocket that is offset and opens toward the back panel. When the inserts (or flaps) are inserted in the pockets, the D-ring binding mechanism is anchored to the back panel, adjacent to the spine.

These and other features and advantages of the invention will be apparent to those skilled in the art from the following detailed description of preferred embodiments, taken together with the accompanying drawings, in which:

DETAILED DESCRIPTION OF THE INVENTION

Figure 1A:
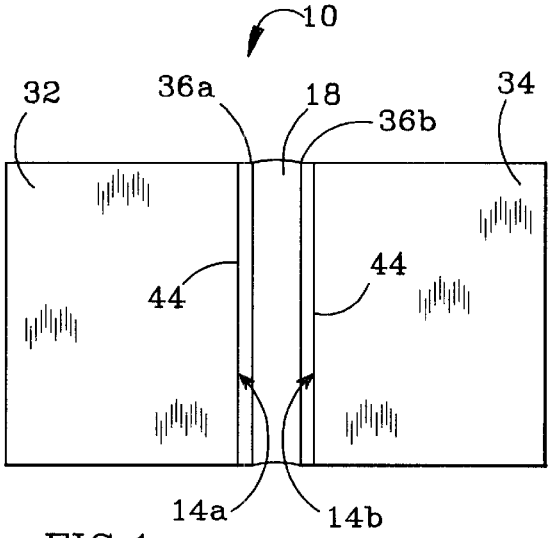
FIGS. 1*a* and 1*b* show a binding hardcover in it's open and closed positions, respectively.
Figure 1B:
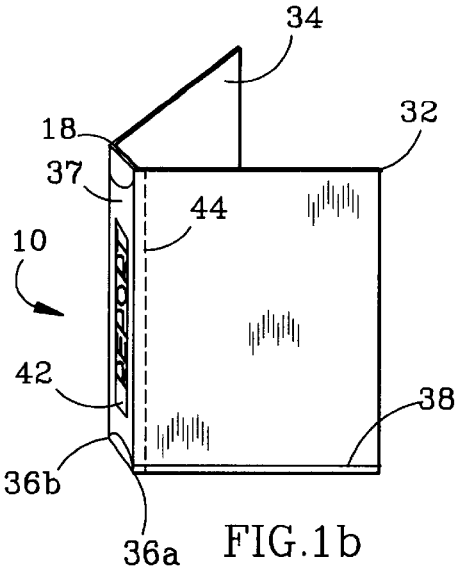
Figure 2:
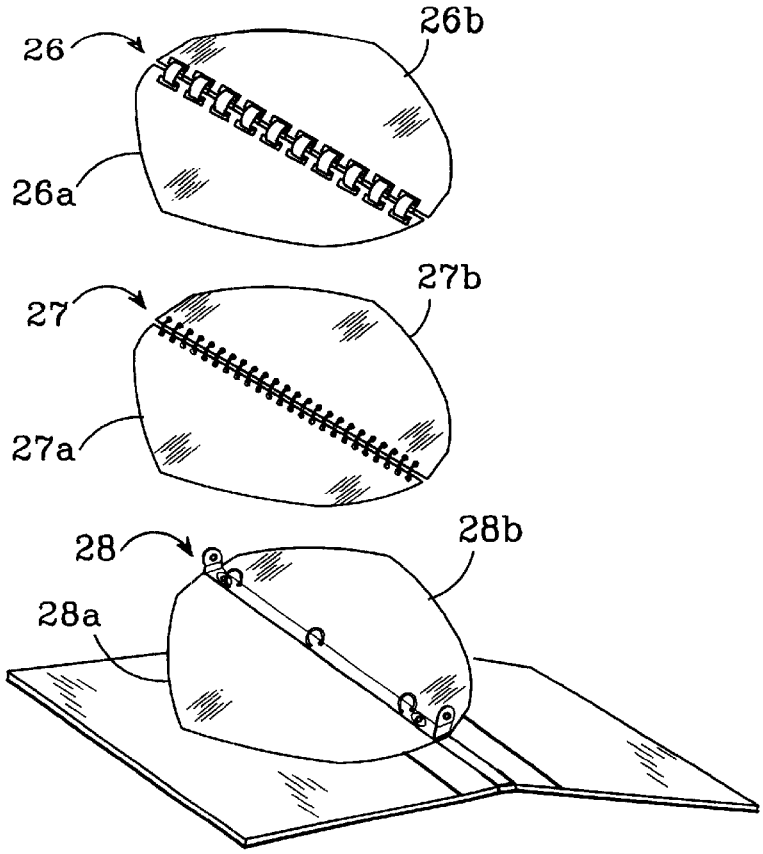
FIG. 2 is a perspective view of the binding hardcover with three alternative binding mechanisms that can be removably mated with the binding hardcover.

The present invention is a hardcover binder with removable and interchangeable binding mechanisms such as 3-ring, D-ring, plastic comb, spiral, double wire, Velobind or thermal bind. As shown in FIGS. 1*a*, 1*b* and 2, the binder hardcover 10 has a pair of interior pockets 14*a* and 14*b* that are offset from and open towards the hardcover's spine 18. The invention also comes with two inserts (or flaps) that are integrated with the respective binding mechanism. The inserts can be removably inserted and fit snugly into pockets 14*a* and 14*b*, respectively, to anchor the binding mechanism against the spine 18. The provision of a pair of opposing pockets on opposite sides of the binding mechanism resists any side-to-side or twisting movement of the binding mechanism, prevents movement of the binding mechanism, and prevents the binding mechanism from falling out accidentally.

As shown in FIGS. 1*a* and 1*b*, the hardcover 10 is suitably manufactured by thermally sealing polyvinyl over chip board or PVC inserts. The hardcover 10 includes rigid front and back panels 32 and 34, respectively, that are joined along a spine 18. Thermal sealing creates seams 36*a* and 36*b* in the polyvinyl that respectively separate the front and back panels from spine 18. As shown, spine 18 is either a soft spine formed only from the polyvinyl or a hard spine formed with a rigid insert inside the polyvinyl.

Spine 18 can be labeled by imprinting the polyvinyl directly or, as shown in FIG. 1*b*, by placing a clear plastic 38 around cover 18 that is thermal sealed along seams 36*a* and 36*b* to define a clear sleeve 37 into which labeled insert 42 can be placed, for example, using the self-loading technique described in U.S. Pat. 4,681,472. Alternately, seams 36*a* and 36*b* can be merged to provide the spine for separating the covers similar to a magazine.

In the embodiment shown in FIG. 1*a*, the interior pockets 14*a* and 14*b* are formed on the interior of the panels by thermal sealing pieces of polyvinyl material that have the same height and a slightly smaller width than the front and back panels 32 and 34. The reduced width produces an offset from the spine at the open end of the pocket, the larger the mechanical binding, the larger the preferred offset. As shown, the edge 44 of each pocket lies parallel to spine 18. However, other shapes may be found to provide a better combination of ease of insertion and a snug fit. Furthermore, edge 44 can be heat-sealed to increase the pocket's stiffness and reduce its deformation over time.

FIG. 2 shows three alternative types of binding mechanisms that can be removably mated with the hardcover 10; a plastic comb binder 26, a spiral binder 27, and a 3-ring binder 28. Each binding mechanism has a pair of inserts (or flaps) affixed to or integrated into the binder mechanism. For instance, plastic comb binder 26 has two inserts 26*a* and 26*b* that can be perforated and included as part of the binding mechanism by collating and bounding the inserts with the printed material. This is easily accomplished by simply slipping the blank inserts into the normal binding process as the first and last pages of the printed material. Alternatively, the plastic comb binding mechanism can be mounted to the vertical center of a single section of insert material having a shape similar to the two inserts laid side-by-side with the tips opposing. This alternative results in two opposing insert flaps similar to the separate inserts. The spiral binding mechanism 27 functions in the same manner and is either integrated with inserts 27*a* and 27*b* or is mounted on single section of insert material.

Figure 7:
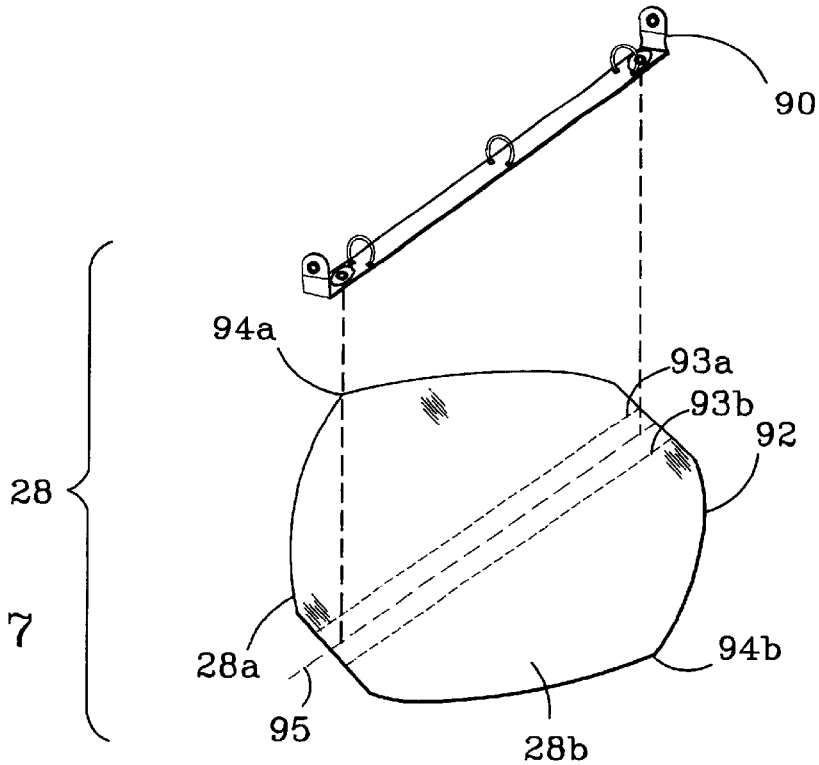
FIG. 7 is a perspective view showing how the 3-ring binding element is affixed to a single section of insert material.

In the case of a three 3-ring binding mechanism 28 using two separate inserts, the inserts are not perforated, but can be affixed to the 3-ring binder assembly as a blank, usually by rivets. In the preferred embodiment, the 3-ring binding mechanism 28 is affixed to a single section of insert material described above, usually by rivets. As shown in FIG. 7, the 3-ring binding element 90 is mounted to the vertical center line of the single section of insert material 92 resulting in two opposing insert flaps 28*a* and 28*b*.

The binding mechanisms are mounted in the hardcover by inserting the inserts or flaps into the pockets 14*a* and 14*b* and providing a snug fit in their respective pocket. The binding mechanism is held against spine 18 and any paper material bound with the binding assembly is held within hardcover 10, between front and back panels 32 and 34. The pair of interior pockets and inserts greatly reduces the side-to-side movement of the binding mechanisms and prevent it from accidentally falling out.

Figure 3A:
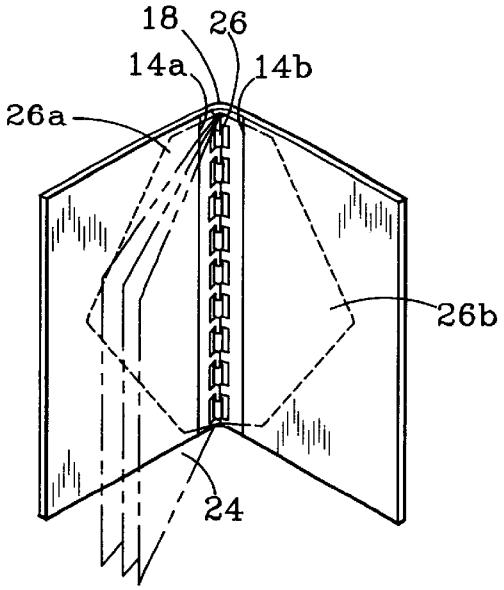
FIG. 3*a* is a perspective view of a plastic comb binding mechanism mounted in the hardcover binder.
Figure 3B:
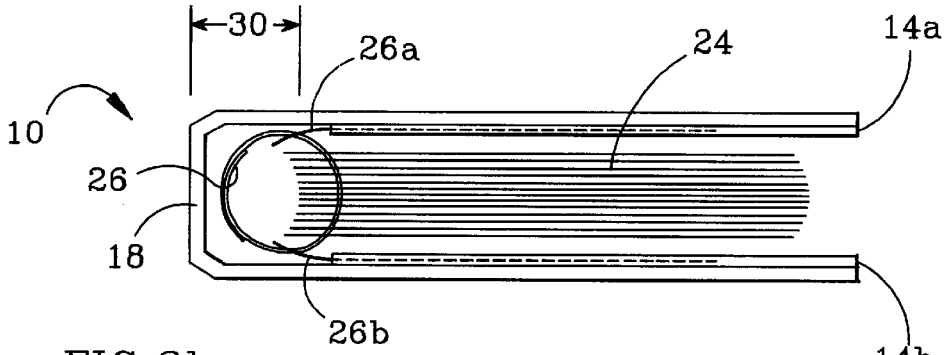
FIG. 3*b* is an end view of the binder and binder mechanism of FIG. 3*a*, with the hardcover closed.

FIGS. 3*a* and 3*b* show a plastic comb binding mechanism 26 bound with inserts 26*a* and 26*b* and printed material 24, the inserts inserted in the respective pockets 14*a* and 14*b*. FIG. 3*b* shows the circular cross-section of the binding mechanism 26. The pocket offset 30 is preferably wide enough that the inserts do not pinch the binding mechanism when the cover is closed and narrow enough to constrain the side-to-side movement of the binding mechanism when the cover is open, suitably between one to two times the radius of the of the mechanical binding.

Figure 4:
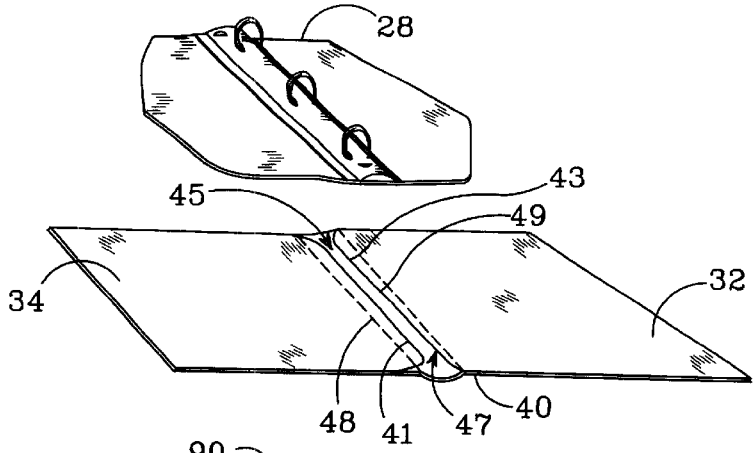
FIG. 4 is a perspective view of the tabbed embodiment of the hardcover and a 3-ring binding mechanism.

FIG.4 shows a second embodiment of the new hardcover 40 that is used primarily with 3-ring binder mechanisms 28.and when the binding mechanism is installed, the edges 41 and 43 of the interior pockets 43 and 44 are hidden behind the binding element. Interior pockets 45 and 47 are formed by thermal sealing pieces of polyvinyl material that are the same size as the front and back panels 32 and 34 but include a tab 48 and 49 running along the open edge of the pockets. The opposing tabs overlap the spine and when the 3-ring binder assembly 28 is installed, the tabs 48 and 49 will tuck under the binding assembly between the inserts and the binding assembly; hiding the tabs the binder assembly. The mated binder assembly and hardcover will not have visible pocket edges and will appear the same as a permanently affixed assembly, showing no evidence of the pockets 45 and 47.

Figure 5:
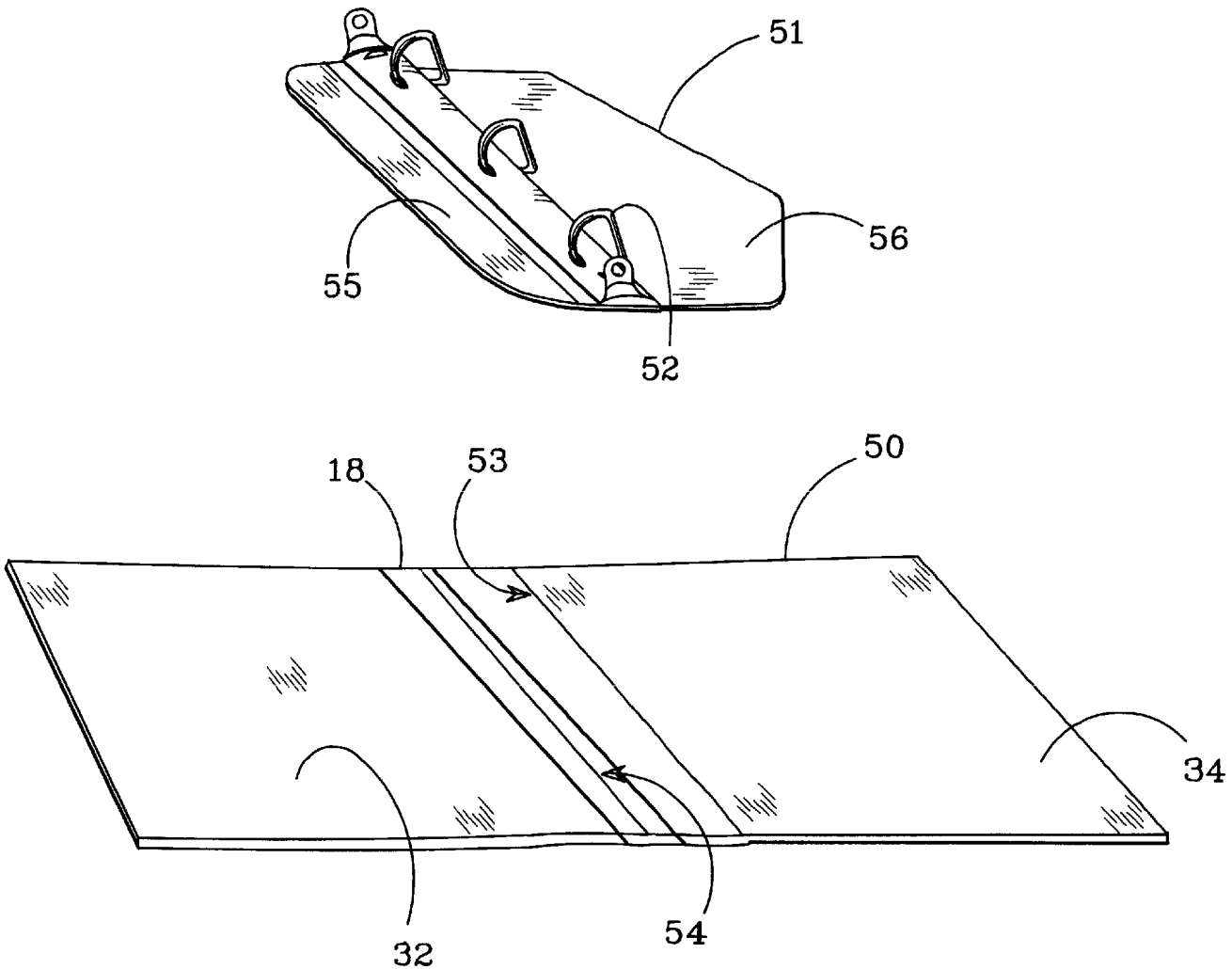
FIG. 5 is a perspective view of D-ringed embodiment of the hardcover and a D-ring binding mechanism.

FIG. 5 shows a third embodiment of the new hardcover 50 used with D-ring binder mechanisms 51 which has binder rings 52 that are D-shaped. The binder mechanism 51 is mounted on the back panel of the hardcover, not the spine. The mounting location is achieved by offsetting the back panel pocket 53 and having a smaller offset spine pocket 54 located on the hardcover spine 18. The back panel pocket 53 is formed by thermal sealing a piece of polyvinyl material to the back panel 34 having the same height as the back panel and a width reduced an amount equal to the width of the D-ring binding mechanism plus a small offset. The edge of the back panel polyvinyl material closest to and parallel to the spine is not heat sealed, leaving a pocket 53 opening toward the spine 18. The spine pocket 54 is formed by thermal sealing a piece of polyvinyl material to the interior of the spine 18 that is the same height as the spine but has a reduced width. The edge of the spine polyvinyl material adjacent to the back panel 34 is not heat sealed leaving an pocket 54 opening toward the back panel 34. A pocket is not formed on the inside of the front panel.

An advantage of the D-ring embodiment is ability to mount the binding mechanism in the hardcover, without riveting through the back panel 32. In conventional D-ring binders, the binding mechanism is not riveted to the spine but is riveted to the back panel, resulting in protruding rivets that often damage or interfere with printing/artwork on the back panel. The new binder prevents possible rivet damage to the back panel.

FIGS. 6*a* through 6*e* illustrate a variety of insert pairs that have a shape and construction that facilitates insertion into pockets 14*a* and 14*b* and provides a snug fit once inside the pockets. The inserts are can be provided as blanks that the user can punch to match the particular type of binding assembly, such as plastic comb or spiral. In the case of a 3-ring binder or D-ring binder, the blanks can be affixed to the binder mechanism with rivets. As shown in FIG. 5, the D-ring binder insert 55 that is inserted into the spine pocket 54 must be reduced in width to fit the reduced width of the spine pocket. The spine insert 55 should be more rectangular in shape to provide a snug fit within the spine pocket 55.

To simplify insertion, the insert material for the insert pairs and single section is preferably flexible and slick, and formed with apposing tips to initiate insertion. To provide the snug fit, the material is preferably strong and rigid, and formed with a trailing portion that has a height approximately equal to the height of the pocket. They can be both flexible to curl for purposes of insertion and rigid to maintain its shape once in the pocket. They are suitably formed from PVC, which is flexible, slick, strong and rigid, and can be easily formed into any desired shape. Furthermore, the larger the intended mechanical binding, the heavier the gauge of PVC.

Figure 6A:
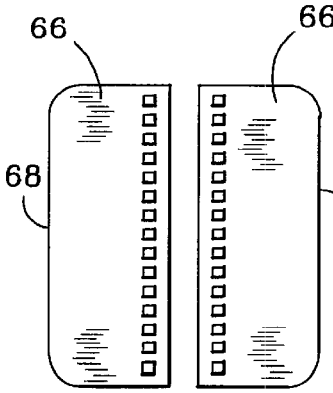
FIG. 6*a* is a plan view of one embodiment of the inserts that can be mounted on or affixed to the binding mechanisms and used to mount the binding mechanism to the binder hardcover.

As shown in FIG. 6*a*, the simplest inserts 66 have a rectangular shape with a width suitably one-quarter to one-half the width of the cover and a height approximately equal to the pocket. Insertion is simplified by reducing the width of the insert from the full width of the cover. However, since the leading edge 68 extends the full height of the insert it can be difficult to get into the pocket initially. Once in place, the rectangular insert provides a snug fit that won't twist or slide.

Figure 6B:
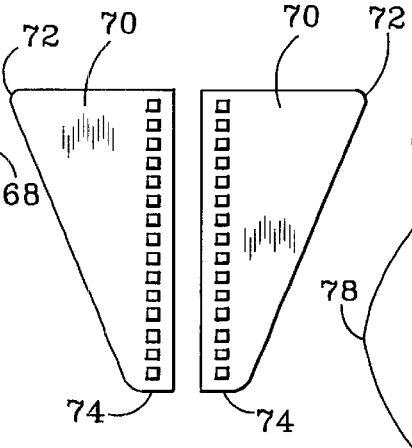
FIG. 6*b* is a plan view of a second embodiment of the inserts that cab be used as the inserts in FIG. 6*a;*

As shown in FIG. 6*b*, tapered inserts 70 form a tip 72 at one end of the insert and taper outward so that a significant portion, suitably 2 inches, of the trailing end 74 of the insert attains approximately the full height of the pocket. Tip 72 eases the initial insertion of inserts 50*a* into the pockets and trailing end 74 provides the snug fit. However, the tapered shape can be somewhat awkward to handle while inserting into the pocket.

Figure 6C:
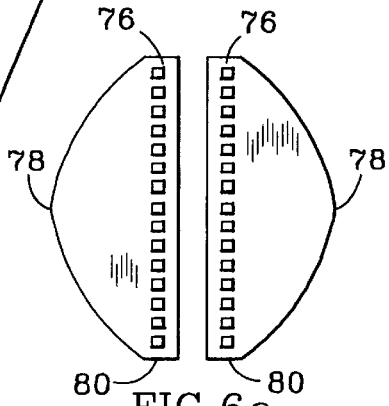
FIG. 6*c* is a plan view of a third embodiment of the inserts that can be used as the inserts in FIG. 6*a;*
Figure 6D:
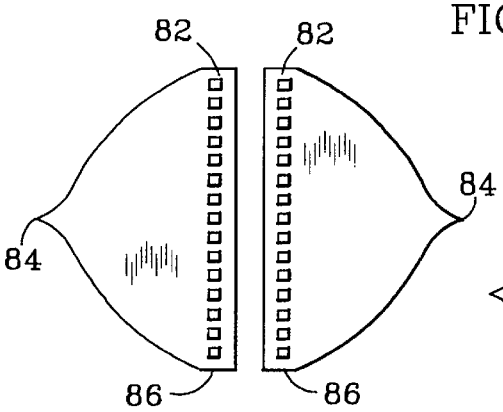
FIG. 6*d* is a plan view of a fourth embodiment of the inserts that can be used as the inserts in FIG. 6*a;*
Figure 6E:
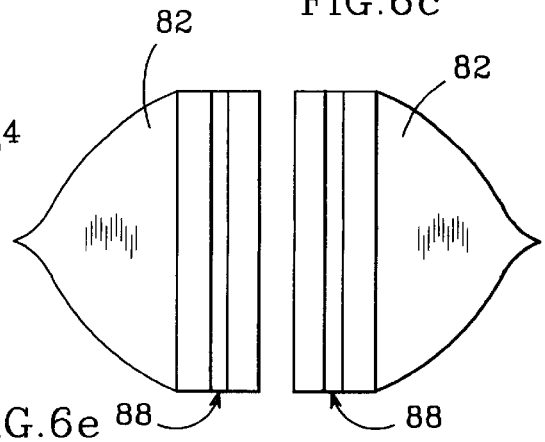
FIG. 6*e* is a plan view of a fifth embodiment of the inserts that can be used as the inserts in FIG. 6*a;*

As shown in FIG. 6*c*, inserts 76 have a tip 78 formed approximately halfway between its ends and tapers symmetrically with a convex curvature until it attains the approximate height of the pocket near its trailing end 80. By placing tip 78 in the middle and tapering symmetrically to the full height of the pocket, the insert is easier to handle and feed into the pocket. As shown in FIG. 6*d*, inserts 82 taper symmetrically from a tip 84 with a concave curvature until it attains the approximate height of the pocket near its trailing end 86. The concave shape is even easier to handle and once tip 84 is in the pocket it tends to self-feed insert 82 until it fits snugly in the pocket. As shown in FIG. 6*e*, the concave insert 82 is scored 88 for use with Vellobind mechanical binding.

Figure 8:
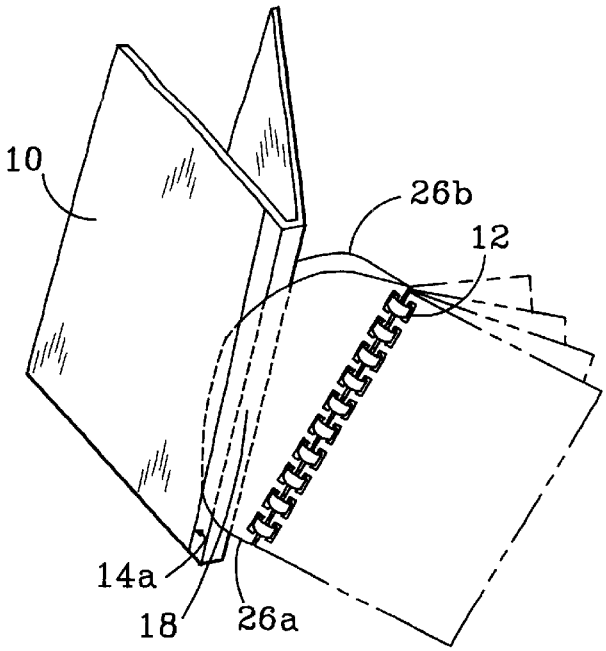
FIG. 8 is a perspective view showing one method for placing the inserts (or flaps) of a plastic comb binding mechanism in the hardcover's interior pockets.
Figure 9A:
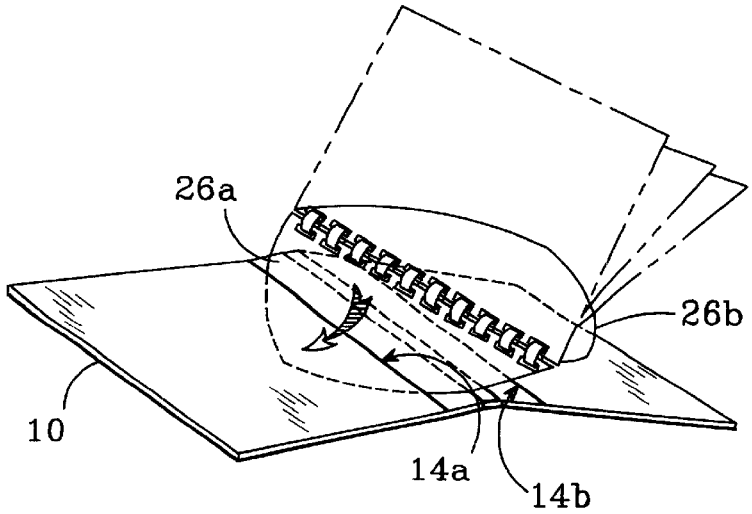
FIG. 9*a* is a perspective view showing the first step in a second method for placing the inserts (or flaps) of a plastic comb binding mechanism in the hardcover's interior pockets.
Figure 9B:
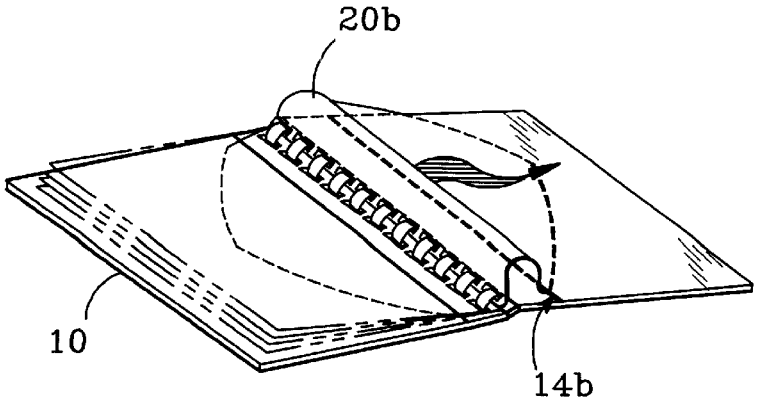
FIG. 9*b* is a perspective view showing the second step in the method of FIG. 9*a;*

FIG. 7 shows how a 3-ring binding element 90 is affixed to a single section of insert material 92, preferably by rivets. Other binding elements can also be mounted to a single section 92 in a similar fashion. The single section 92 has two flaps 28*a* and 28*b* which have a similar shape and composition to the inserts shown in FIGS. 6*a–e*. However, in the preferred embodiment the flaps 28*a* and 28*b* are similar the inserts in FIG.6*c*. The single section 92 has two thermal or pressure scores 93*a* and 93*b* that are parallel and equidistance from the center line 95 and are separated by a distance equal to the width of the binding element 90. The scores allow the single section to fold along the longitudinal edge of the binding element. The flaps 28*a* and 28*b* have a tip 94*a* and 94*b* formed approximately halfway between its ends and tapers symmetrically with a convex curvature until it attains the approximate height of the pocket near its trailing end. By placing tips 94*a* and 94*b* in the middle and tapering symmetrically to the full height of the pocket, the flaps are easy to handle and feed into their respective pocket FIGS. 8 and 9*a–b*, illustrate two possible methods of mounting a plastic comb binding mechanism 26 into hardcover 10 by inserting inserts 26*a* and 26*b* into pockets 14*a* and 14*b*, respectively, so that they fit snugly to anchor the mechanical binding assembly against the spine inside hardcover 10. Since inserts 26*a* and 26*b* are preferredly sold as blanks, the user must first punch, collate and bind them with the printed material. As shown in FIGS. 9*a* and 9*b*, binder hardcover 10 is opened and placed on a flat surface. A user places the tip of insert 26*a* in pocket 14*a* and feeds the insert into the pocket until it fits snugly. The user then curls insert 28*b* so that its tip can be placed in pocket 14*b* and then fed into the pocket until it fits snugly. Alternatively, the back insert 26*b* can be inserted first. Once in place, the mechanical binding is bound fairly tightly and will not fall out accidentally. The mechanical binding can be removed by turning the cover inside out and pulling on the inserts.

As shown in FIG. 8, the technique for removing the binding mechanism can also be used to insert the binding.

The user turns the hardcover inside out to expose its spine and pockets 14*a* and 14*b*, while turning 26*a* and 26*b* inside out. Thereafter, the user places inserts 20*a* and 20*b* into pockets 14*a* and 14*b*, respectively, until both inserts fit snugly inside the respective pockets and then closes the cover. This approach does not require curling one of the inserts. As a result, heavier gauge plastic or even rigid inserts may be used.

Figure 10:
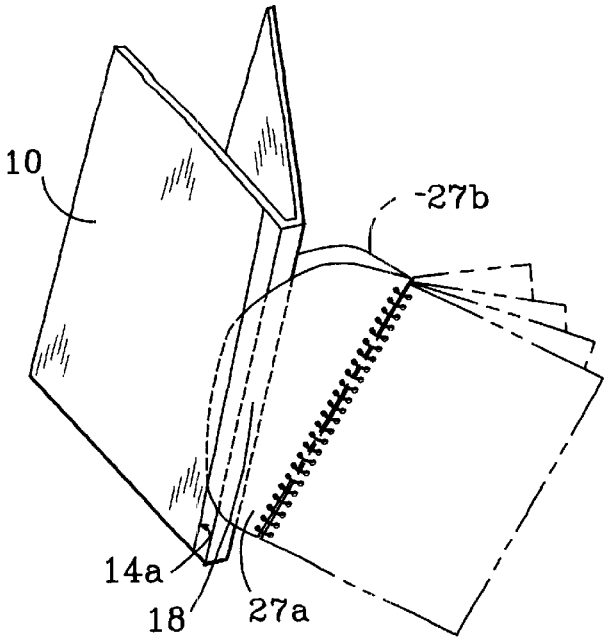
FIG. 10 is a perspective view showing one method for placing the inserts (or flaps) of a spiral binding mechanism in the hardcover's interior pockets.
Figure 11A:
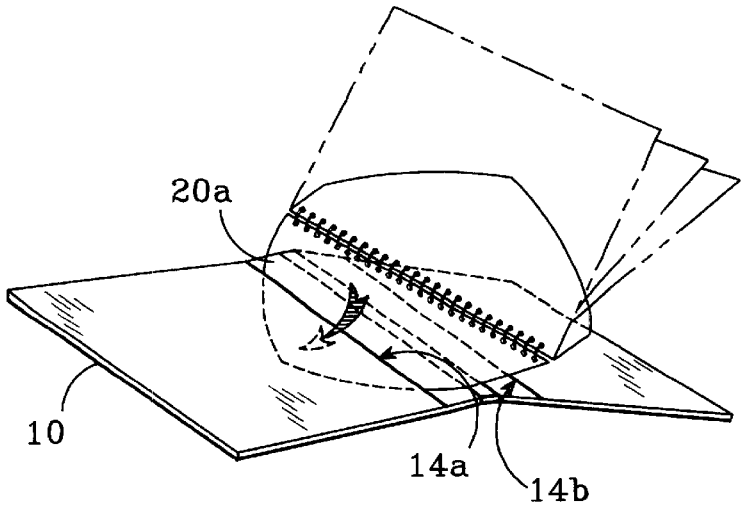
FIG. 11*a* is a perspective view showing the first step in a second method for placing the inserts (or flaps) of a spiral binding mechanism in the hardcover's interior pockets.
Figure 11B:
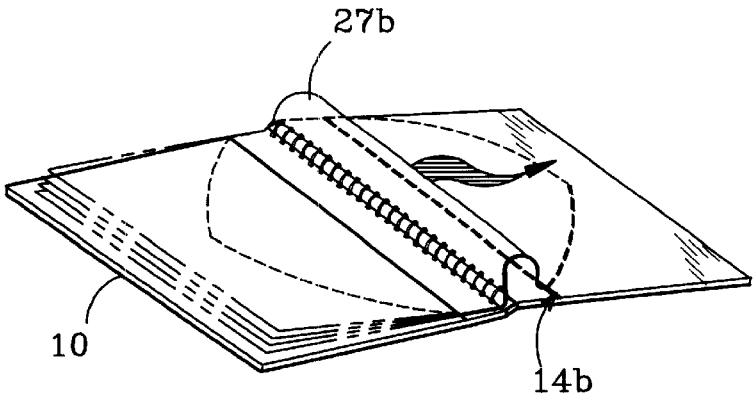
FIG. 11*b* is a perspective view showing the second step in the method of FIG. 11*a;*
Figure 12:
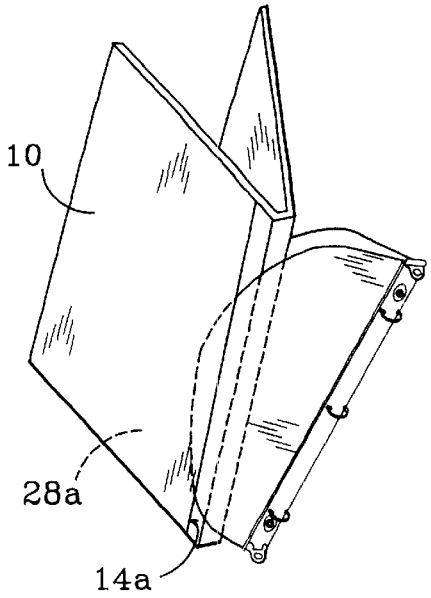
FIG. 12 is a perspective view showing one method for placing the inserts (or flaps) of a 3-ring binding mechanism in the hardcover's interior pockets.
Figure 13A:
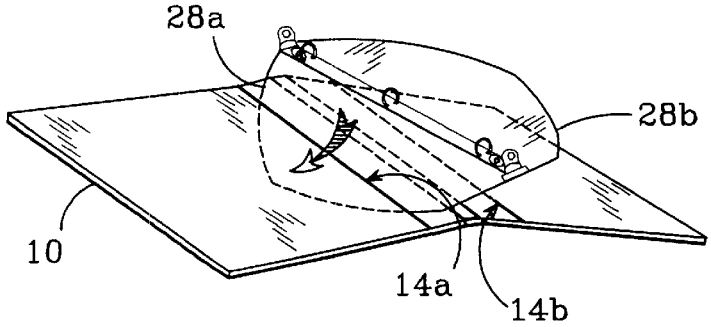
FIG. 13*a* is a perspective view showing the first step in a second method for placing the inserts (or flaps) of a 3-ring binding mechanism in the hardcover's interior pockets.
Figure 13B:
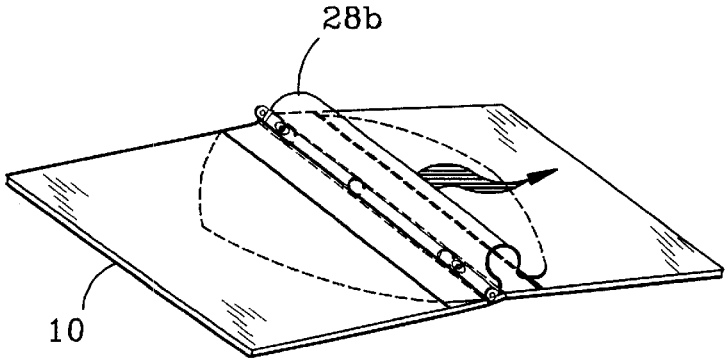
FIG. 13*b* is a perspective view showing the second step in the method of FIG. 13*a*.

FIGS. 10 and 11*a–b* show the same insertion methods using a spiral binding mechanism 27 using inserts 27*a* and 27*b*. In the preferred embodiment, the inserts 27*a* and 27*b* are bound with the printed material and the spiral binding mechanism 27 can be inserted or removed just as the plastic comb binding mechanism 26. FIGS. 12 and 13*a–b* show the 3-ring binder assembly also being inserted using the same methods. However, in the preferred embodiment, the 3-ring binding mechanism is mounted on a single insert section and is inserted without printed material.

Figure 14:
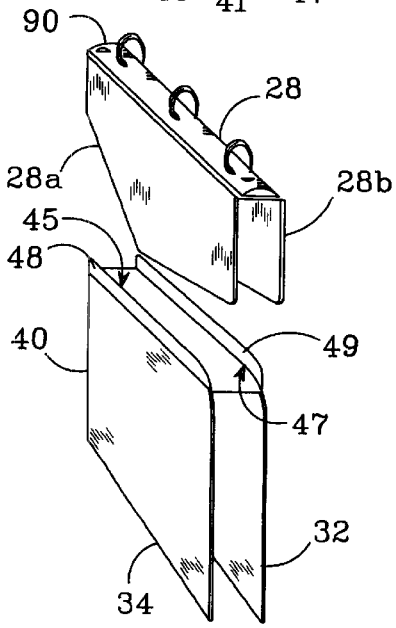
FIG. 14 is a perspective view showing the first step in one method for placing the inserts (or flaps) of a 3-ring binding mechanism in the tabbed hardcover's interior pockets.
Figure 15A:
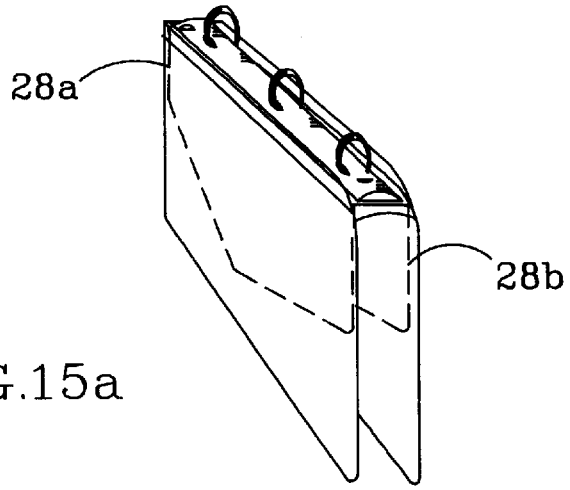
FIG. 15*a* is a perspective view showing the second step in the method of FIG. 14.
Figure 15B:
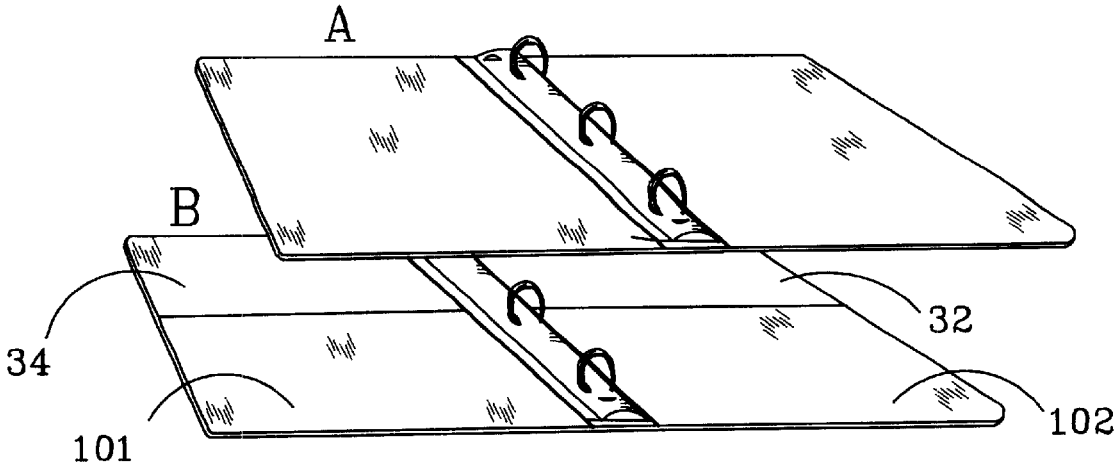
FIG. 15*b* is a perspective view showing the third step in the method of FIG. 14.

FIGS. 14 and 15*a–b* show the insertion method for the tab hardcover 40. The user turns the hardcover inside out to force the pocket tabs 48 and 49 away from the hardcover spine, exposing the entire interior surface of the spine. The inserts (or flaps) 28*a* and 28*b* are also turned inside out and aligned with the pockets 45 and 47. As shown in FIG. 15*a*, the user slides inserts 28*a* and 28*b* into pockets 45 and 47 respectively, until both inserts fit snugly inside the respective pockets and the binding element 90 is anchored against the spine. As the hardcover is closed, the pocket tabs will initially rest on top and along the edge of the binding element 90. As the hardcover is further closed, the rigidity of the pocket tabs 48 and 49 will allow the pocket tabs to snap under the binder element 90, hiding the tabs. As shown in FIG. 15*b*, the assembled hardcover and binder mechanism appears as a permanently affixed hardcover and binder mechanism, with the pocket edges 41 and 43 hidden behind the binding element 90. Storage pockets 101 and 102 can be included along the full width of the interior of the front panel 34 and back panel 32. The binding mechanism 28 can be removed from the hardcover 40 by turning the hardcover inside out and allowing the pocket tabs to snap from underneath the binding element 90. The binding mechanism 28 can be separated from the hardcover 40 by pulling the two apart.

Figure 16B:
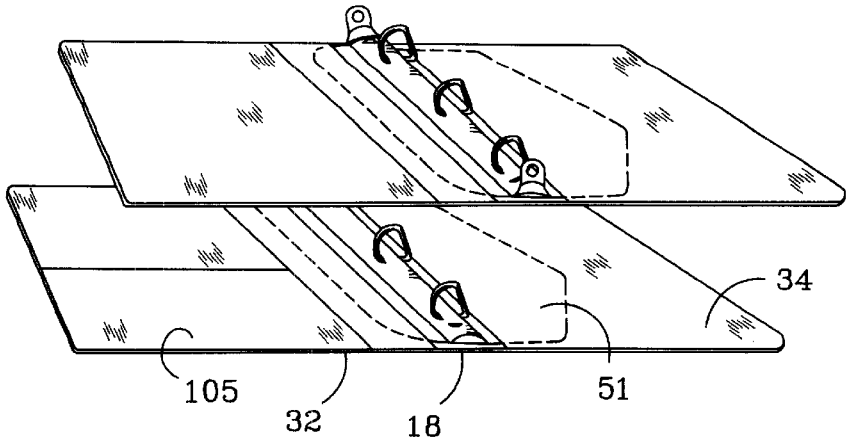
FIG. 16*b* is a perspective view showing a D-ring binding mechanism with its inserts in the interior pockets of two different hardcovers.
Figure 16A:
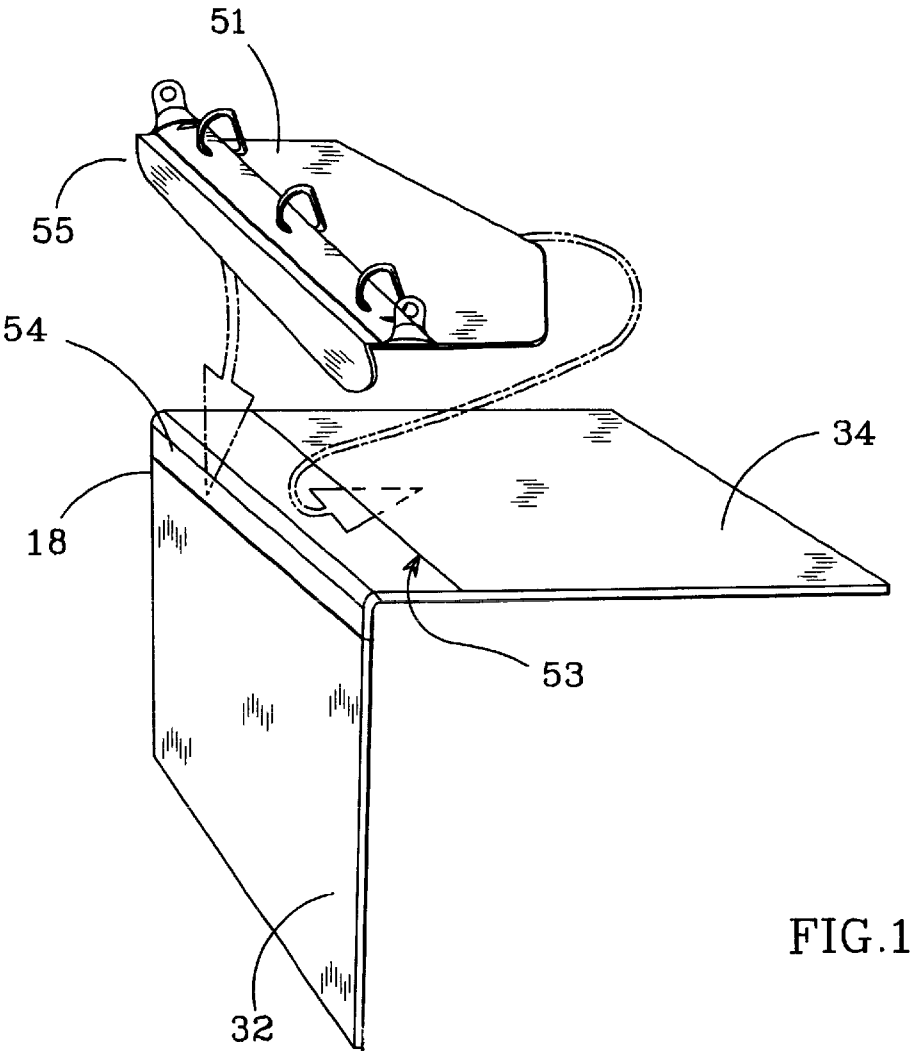
FIG. 16*a* is a perspective view showing a method for placing the inserts (or flaps) of a D-ring binding mechanism in the hardcover's interior pockets.

FIGS. 16*a* and 16*b* show the insertion method for a binding mechanism anchored to the back panel 34, such as a D-ring binder mechanism 51. The front panel 32 and spine 18 are turned inside out and the spine insert 55 is turned inside out. The spine insert 55 is aligned with and inserted into the spine pocket 54. The hardcover 50 is then laid flat and the tip of insert 51 is curled so that its tip can be placed in pocket 53 and fed into the pocket until if fits snugly. As shown in FIG. 16*b*, once the D-ring binder mechanism 51 and hardcover 50 are assembled, the binding mechanism 50 is offset from the hardcover spine 18 and anchored on the back panel 34. Because the front panel 32 does is not used for mounting the binding mechanism 51, a full width interior storage pocket 105 can be included. The D-ring binding mechanism 51 can be removed from the hardcover 50 by turning the front panel 32 and the spine 18 inside out and separating the binding mechanism 51 from the hardcover 50.

Figure 17:
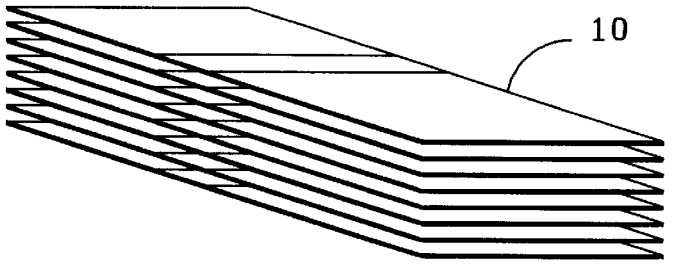
FIG. 17 is a perspective view of stacked hardcovers positioned so the heat seal on the edge can be sheered off.

By having a hardcover that can be interchanged with various binding mechanisms, the hardcover and the binding mechanisms can be re-used and recycled. In the past, if the hardcover wore out before the binding assembly or vice versa, the entire binder was discarded. Using the invention, the hardcover and the binding mechanism can be taken apart and the portion with the remaining useful life can be re-used. The remaining portion can be recycled. FIG. 17 shows how the recycled hardcovers 10 could be stacked to allow the heat seal on the edge of the hardcovers to be sheered off by an industrial cutter. The PVC can then be removed from the underlying chip boards and both can be recycled. The present invention also provides flexibility in binder use, allowing for the hardcover to be used with many different types of binding mechanisms.

Figure 18:
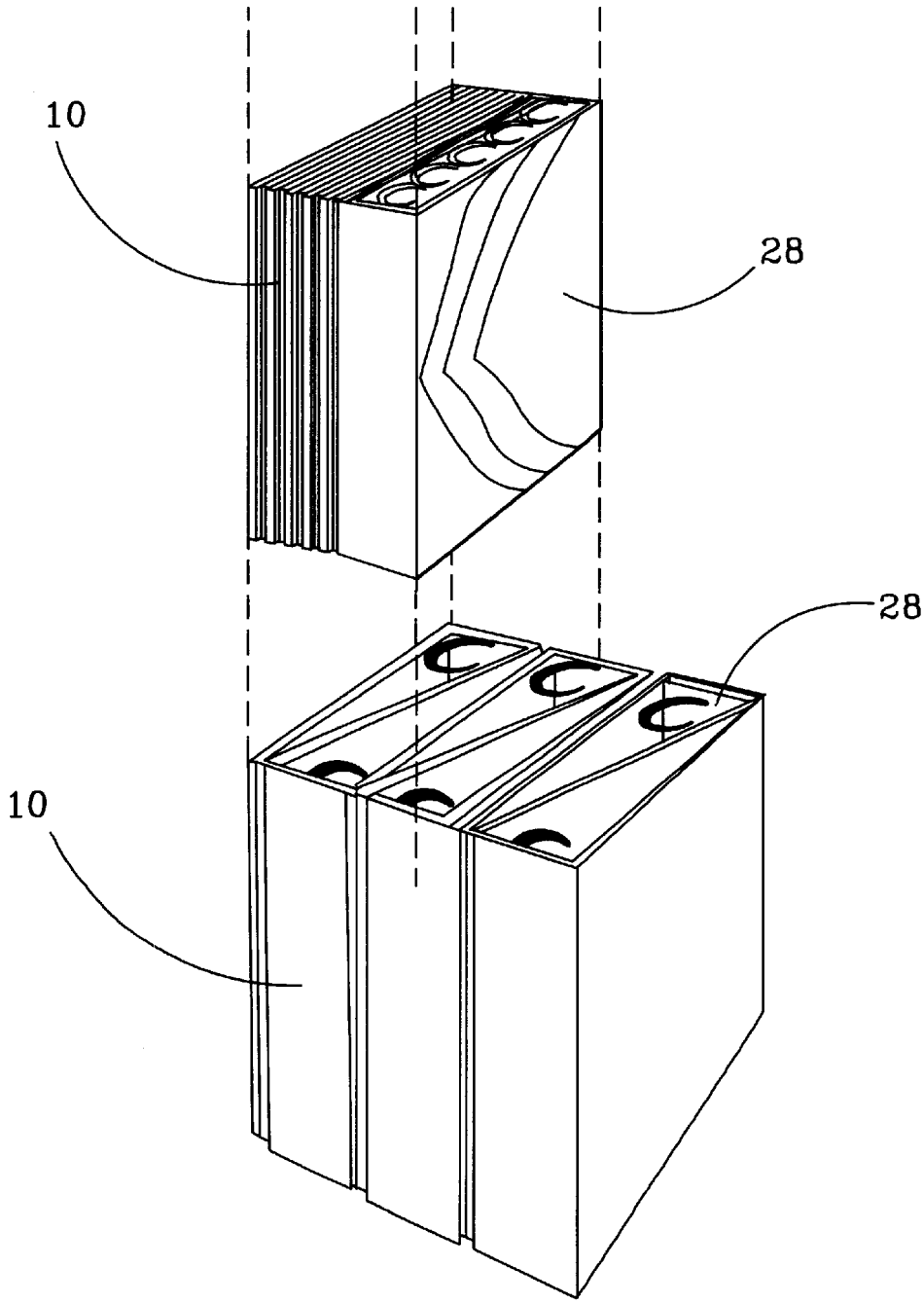
FIG. 18 is a perspective view of how hardcover and binding mechanism assemblies according to the present invention can be stored compared to conventional assemblies.

The invention also provides for substantial savings in space during shipping and storage. The hardcovers can be shipped without the binding mechanism inserted. The hardcovers can be laid flat with additional hardcovers stacked on top and the corresponding binding mechanisms can be stacked or arranged next to one another for shipping and storage. FIG. 18 shows the hardcover 10 with the binder mechanisms 28 inserted for shipping and storage. FIG. 18 also shows the hardcover 10 with the binding mechanism 28 removed for storage shipping and storage. With the binding mechanism 28 removed, the same number of hardcover binders can be shipped and stored in a much smaller container.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

I claim:

1. A printed material binder, comprising:

a hardcover binder having front and back binder panels that are joined at a spine, said front and back binder panels each having an interior pocket that opens towards the spine;

a binder mechanism for holding printed materials; and a pair of-opposing inserts that are integrated with said binding mechanism, said binding mechanism and said inserts forming a separate unit that is removably mated with said hardcover binder to form said printed material binder, said inserts being removably insertable and snugly fit into said pockets to hold said binding mechanism against said spine and between said front and back binder panels, said inserts being rigid enough to maintain their shape within said pockets, said pockets allowing slight movement of the inserts and binding mechanism, thereby providing a cushion that helps prevent said printed material on said binder mechanism from forcing said binding mechanism open when said printed material binder is jarred;

said inserts having tips that are formed approximately halfway between the ends of their respective inserts and taper to an approximate height of said pocket, making each said insert easier to handle and feed into its respective pocket.

2. The printed material binder of claim 1, wherein said interior pockets are offset from said spine.

3. The printed material binder of claim 2, wherein said offset is wide enough that said inserts do not pinch said binding mechanism when said cover is closed and narrow enough to constrain the side-to-side movement of said binding mechanism when said cover is open.

4. The printed material binder of claim 1, wherein said spine provides an exterior surface suitable for labeling the printed material.

5. The printed material binder of claim 1, wherein said opposing insert pairs comprise either separate inserts integrated with said binding mechanism or a single section of insert material having opposing flaps, each flap having a shape similar to one of said opposing inserts, said opposing flaps functioning the same as said opposing insert pairs.

6. The printed material binder of claim 1, wherein said opposing inserts taper with a convex curvature to the approximate height of said pockets.

7. The printed material binder of claim 1, wherein said opposing inserts taper with a concave curvature to attain a height approximately equal to the height of their respective pocket to provide said snug fit, said concave curvature allowing said inserts to self-feed into their respective pocket after their respective said tip is inserted.

8. The printed material binder-of claim 7, wherein said inserts or flaps are flexible enough to curl for insertion into said pockets.

9. The printed material binder of claim 1, wherein said binding mechanism comprises either a 3-ring, D-ring, plastic comb, spiral, double wire, Velobind or thermal bind binding mechanism.

10. A printed material binder, comprising:

a hardcover binder having front and back binder panels that are joined at a spine, said front and back binder panels each having an interior pocket that opens towards the spine;

a binder mechanism for holding printed materials; and a pair of opposing inserts that are integrated with said binding mechanism, said binding mechanism and said inserts forming a separate unit that is removably mated with said hardcover binder to form said printed material binder, said inserts being removably insertable and snugly fit into said pockets to hold said binding mechanism against said spine and between said front and back binder panels, said inserts being rigid enough to maintain their shape within said pockets, said pockets allowing slight movement of the inserts and binding mechanism, thereby providing a cushion that helps prevent said printed material on said binder mechanism from forcing said binding mechanism open when said printed material binder is jarred;

said inserts having tips that are formed approximately halfway between the ends of their respective inserts and taper to an approximate height of said pocket, making each said insert easier to handle and feed into its respective pocket, wherein each said interior pocket substantially covers its respective panel and has an overlap tab along the length of the pocket opening, said tab overlapping said spine and tucked under said binding mechanism such that said inserts are hidden within said pockets and said pocket openings are hidden behind said binding mechanism.

11. A binder of printed material, comprising:

front and back binder panels that are joined at a spine, said front and back binder panels each having an interior pocket that opens towards said spine;

a binding mechanism for binding printed material; and a pair of opposing inserts of substantially less width than said panels, said inserts integrated into said binding mechanism, said binding mechanism and said inserts forming a separate unit that is removably mated with said binder panels and said spine to form said binder of printed material, each said insert fitting snugly in a respective one of said interior pockets to mount said binding mechanism against said spine and between said front and back panels;

said pockets and inserts cooperating to resist side-to-side or twisting movement of said binding mechanism, prevent movement of said binding mechanism, and prevent said binding mechanism from falling out of said binder accidentally.

12. The binder of claim 11, wherein said pockets are offset from said spine such that said inserts do not pinch said binding mechanism when said panels are closed and constrains the side-to-side movement of said binding mechanism when said panels are open.

13. The binder of claim 11, wherein said binding mechanism has a circular binding mechanism, said pockets being offset from said spine between one and two times the radius of said binding mechanism.

14. The binder of claim 11, wherein each said pocket has a heat-sealed edge where it opens to receive one of said inserts.

15. The binder of claim 11, wherein said opposing inserts comprise either separate inserts integrated with said binding mechanisms or a single section of insert material having two opposing flaps, each flap having a shape similar to one of said opposing inserts, said opposing flaps functioning the same as said opposing insert pairs.

16. The binder of claim 15, wherein said inserts or flaps have a shape that facilitates insertion and provides a snug fit inside said pockets.

17. The binder of claim 15, wherein said inserts or flaps are rectangularly shaped with a height approximately equal to the height of the pocket to provide said snug fit and a width that is less than the width of said front and back binder panels to facilitate insertion.

18. The binder of claim 15, wherein said inserts or flaps each form a tip for initial insertion into respective one of said pockets and taper so that the insert attain a height approximately equal to the height of their respective pockets to provide said snug fit.

19. The binder of claim 15, wherein the height of said inserts or flaps is approximately equal to the height of said pocket over a width sufficient to provide said snug fit before tapering to said tip.

20. The binder of claim 19, wherein said tips are formed at one end of their respective inserts or flaps.

21. The binder of claim 19, wherein said tips are formed approximately halfway between the ends of their respective inserts and taper with a convex curvature to the approximate height of said pocket.

22. The binder of claim 19, wherein said tips are formed approximately halfway between the ends of their respective inserts and taper with a concave curvature to the approximate height of said pocket.

23. The binder of claim 15, wherein said inserts are flexible enough to curl for insertion into said pockets.

24. The binder of claim 15, wherein said inserts comprise polyvinyl chloride (PVC).

25. The binder of claim 11, wherein said binding mechanism comprises either a 3-ring, D-ring, plastic comb, spiral, double wire, Velobind or thermal bind binding mechanism.

26. A binder of printed material, comprising:

front and back binder panels that are joined at a spine, said front and back binder panels each having an interior pocket that opens towards said spine;

a binding mechanism for binding printed material; and a pair of opposing inserts of substantially less width than said panels, said inserts integrated into said binding mechanism, said binding mechanism and said inserts forming a separate unit that is removably mated with said binder panels and said spine to form said binder of printed material, each said insert fitting snugly in a respective one of said interior pockets to mount said binding mechanism against said spine and between said front and back panels, said interior pockets allowing slight movement of the inserts and binding mechanism, thereby providing a cushion that helps prevent said printed material on said binder mechanism from forcing said binding mechanism open when said binder of printed material is jarred;

said pockets and inserts cooperating to resist side-to-side or twisting movement of said binding mechanism, prevent movement of said binding mechanism, and prevent said binding mechanism from falling out of said binder accidentally, wherein each said interior pocket substantially covers its respective panel and has an overlap tab along the length of the pocket opening, said tab overlapping said spine and tucked under said binding mechanism such that said inserts are hidden within said pockets and said pocket openings are hidden behind said binding mechanism.

27. A D-ring printed material binder, comprising:

a hardcover binder having front and back binder panels that are joined at a spine, said back panel having an interior pocket that is offset and opens toward said spine and said spine having an interior pocket that is offset and opens toward said back panel;

a D-ring binding mechanism for holding printed material; and a pair of opposing inserts that are integrated with said binding mechanism, said binding mechanism and said inserts forming a separate unit that is removably mated with said hardcover binder to form said printed material binder, each said insert being removably insertable and snugly fit into a respective one of said pockets to hold said binding mechanism against the interior of said back panel along the edge joining said spine and said back panel, said inserts rigid enough to maintain their shape within said pockets, said pockets allowing slight movement of the inserts and binding mechanism, thereby providing a cushion that helps prevent said printed material on said binder mechanism from forcing said binding mechanism open when said printed material binder is jarred;

said pockets and inserts cooperating to resist side-to-side or twisting movement of said binding mechanism, prevent movement of said binding mechanism, and prevent said binding mechanism from falling out of said binder accidentally.

28. The binder of claim 27, wherein said back panel pocket offset and said spine pocket offset is wide enough that said inserts do not pinch said binding mechanism when said hardcover is closed and narrow enough to constrain the side-to-side movement of said binding mechanism when said hardcover is open.

29. The binder of claim 27, wherein said spine provides an exterior surface suitable for labeling the printed material.

30. The binder of claim 27, wherein said opposing insert pairs comprise either separate inserts integrated with said binding mechanisms or a single section of insert material having opposing flaps, each flap having a shape similar to one of said opposing inserts, said opposing flaps function the same as said opposing insert pairs.

31. The binder of claim 30, wherein said opposing inserts have a shape that facilitates insertion and provides a snug fit inside said pockets to mount said binding mechanism.

32. The binder of claim 31, wherein said inserts each form a tip for initial insertion into respective ones of said pockets and taper so that the inserts attain a height approximately equal to the height of their respective pocket to provide said snug fit.

33. The binder of claim 30, wherein said inserts are flexible enough to curl for insertion into said pockets.

34. A method of interchanging or replacing a binder binding mechanism, comprising:

providing a binding mechanism for holding printed material, said binding mechanism having a pair of opposing inserts, said binding mechanism and inserts forming a separate unit;

providing a hardcover that has a front and back interior panel each of substantially greater width than said inserts and joined to a spine, said panels having respective interior pockets that are offset from and open towards said spine; and inserting said inserts into respective ones of said pockets so that they fit snugly and anchor said binding mechanism against the spine inside said hardcover_such that said insert and binding mechanism unit is removably mated with said hardcover and said interior pockets allow slight movement of said insert and binding mechanism unit, thereby providing a cushion that helps prevent said printed material on said binding mechanism from forcing said binding mechanism open when said binder is jarred;

said pockets and inserts cooperating to resist side-to-side or twisting movement of said binding mechanism, prevent movement of said binding mechanism, and prevent said binding mechanism from falling out of said binder accidentally.

35. The method of claim 34, wherein said inserts are inserted by:

placing said hardcover on a flat surface in an open position;

inserting one of said inserts into one of said pockets;

curling the other of said insert so that its edge is positioned at the opening to the other of said pockets;

inserting said other insert into said other pocket so that both inserts fit snugly in their respective pockets; and closing said hardcover.

36. The method of claim 34, wherein the inserts are inserted by:

opening said hardcover to expose said spine and said interior pockets;

turning said inserts so that they are next to each other;

inserting said inserts into respective one of said pockets;

pushing said binding mechanism towards said spine until both inserts fit snugly inside their respective pockets to anchor said binding mechanism adjacent to said spine; and closing the hardcover.

37. A method of interchanging or replacing a binder binding mechanism, comprising:

providing a binding mechanism for holding printed material, said binding mechanism having a pair of opposing inserts, said binding mechanism and inserts forming a separate unit;

providing a hardcover that has a front and back interior panel each of substantially greater width than said inserts and joined to a spine, said back panel having an interior pocket that is offset from and open towards said spine and said spine having an interior pocket that is offset form and open towards said back panel; and inserting said inserts into respective ones of said pockets so that they fit snugly and anchor said binding mechanism against said back panel inside said hardcover such that said insert and binding mechanism unit is removably mated with said hardcover and said interior pockets allow slight movement of said insert and binding mechanism unit, thereby providing a cushion that helps prevent said printed material on said binding mechanism from forcing said binding mechanism open when said binder is jarred;

said pockets and inserts cooperating to resist side-to-side or twisting movement of said binding mechanism, prevent movement of said binding mechanism, and prevent said binding mechanism from falling out of said binder accidentally.

* * * * *